US006698602B2

(12) United States Patent
Taylor

(10) Patent No.: US 6,698,602 B2
(45) Date of Patent: Mar. 2, 2004

(54) SHELF ADAPTER FOR A TOWEL RACK

(76) Inventor: Christopher L. Taylor, 3714 Queenswood Pl., Garland, TX (US) 75040

( * ) Notice: Subject to any disclaimer, the term of this patent is extended or adjusted under 35 U.S.C. 154(b) by 0 days.

(21) Appl. No.: 10/077,116

(22) Filed: Feb. 15, 2002

(65) Prior Publication Data

US 2002/0157580 A1 Oct. 31, 2002

Related U.S. Application Data

(60) Provisional application No. 60/268,957, filed on Feb. 16, 2001.

(51) Int. Cl.[7] ..... A47B 73/00

(52) U.S. Cl. ..... 211/74; 211/119.009; 211/90.02; 248/214; 108/42

(58) Field of Search ..... 108/42, 29, 28; 211/119.009, 74, 105.1, 105.3, 90.01, 90.02; 248/214, 311.2, 311.3, 312

(56) References Cited

U.S. PATENT DOCUMENTS 2,820,687 A * 1/1958 Waring ..... 108/42
4,154,420 A * 5/1979 Mazie et al. ..... 248/251
4,181,382 A * 1/1980 Harvey ..... 108/152
4,285,484 A * 8/1981 Follows ..... 248/235
D288,998 S * 3/1987 Wiggins ..... D6/524
4,799,432 A * 1/1989 Rickner ..... 108/42
4,827,849 A * 5/1989 Vignale ..... 108/29
4,870,907 A * 10/1989 McKee ..... 108/42
5,169,010 A * 12/1992 Fortner ..... 211/86.01
5,255,401 A * 10/1993 Sambrookes et al. ..... 4/605
5,433,152 A * 7/1995 Henry ..... 108/42
5,439,193 A * 8/1995 Coulter et al. ..... 248/206.3
5,568,772 A * 10/1996 Carson ..... 108/42
6,244,448 B1 * 6/2001 Hang ..... 211/105.1
6,345,723 B1 * 2/2002 Blake et al. ..... 211/74

* cited by examiner

*Primary Examiner*—Lanna Mai
*Assistant Examiner*—Jerry A. Anderson
(74) *Attorney, Agent, or Firm*—George L. Williamson

(57) ABSTRACT

The present invention discloses a shelf adapter for attachment to a conventional towel rack for use in a bathroom, shower stall, or the like. The present invention comprises a pair of parallel generally horizontal members having a female and male telescoping attachment means mounted onto a pair of leg-like mounts which are fastened around the towel rack so as to be removably, fixedly attached to the towel rack. The purpose of the telescoping members is to allow the shelf to be removably, fixedly attached to towels racks of various sizes wherein the telescoping members can be adjusted to fit towel racks of varying lengths. Furthermore, the parallel members have indentions or cutouts disposed therein which form semi-circular cutouts for receiving bottles or bottle necks of various bottled bath condiments which the user might use. The bottles are mounted upside down into the semi-circular cutouts in order to always have the liquid contained in the bottle disposed near the outlet end of the bottle.

5 Claims, 2 Drawing Sheets

SHELF ADAPTER FOR A TOWEL RACK

This application claims benefit of Provisional Application Ser. No. 60/268,957 filed on Feb. 16, 2001, now abandon.

BACKGROUND OF THE INVENTION

1. Field of the Invention

The present invention generally relates to towel racks and, more particularly, is concerned with a shelf adapter for a towel rack.

2. Description of the Prior Art

Shelf adapters for towel racks have been described in the prior art. However, none of the prior art devices disclose the unique features of the present.

In U.S. Pat. No. 4,870,907, dated Oct. 3, 1989, McKee disclosed a shelf that can be installed on various lengths existing towel bars using double-sided adhesive tape. The shelf is a convenience item that will not interfere with the original use of a towel bar with opposite side mounting brackets fastened to the underside of the shelf with double-sided adhesive tape supporting the shelf well above the towel bar. The shelf element itself has a rear flange that is fastened to a wall with double-sided adhesive tape to further securely mount the shelf in place above a towel bar. Bracket triangular knock-outs are provided for adaptation to mounting on the top pointed towel bars.

In U.S. Pat. No. 4,827,849, dated May 9, 1989, Vignale disclosed a shelf assembly which has a horizontal toiletry article supporting tray with wedge-shaped brackets formed as depending extensions of the left and right ends of the tray. Vertical rear edges of the brackets abut a wall and angled front edges bear against a conventional towel bar to removably secure the shelf behind the bar and to elevate the tray to permit normal usage of the bar to hang towels. The rear of the tray has an upwardly extending flange which serves as a shelf back abutting the wall Rods are provided on its left, front and right edges to present a raised lip to keep articles on the shelf. The tray, brackets and flange are preferably formed as an integral, unitary structure of acrylic plastic.

In U.S. Pat. No. 5,921,410, dated Jul. 13, 1999, Emery, et al., disclosed an invention directed to a multipurpose, mountable shelf which is easily collapsible for cost effective transportation. The device is assembled with ease by the end user and is characterized by a unique, yet simple locking mechanism for stable, structural integrity.

In U.S. Pat. No. 5,433,152, dated Jul. 18, 1995, Henry disclosed a shelf for mounting on the towel bar and the like, comprising a tray positionable in a horizontal orientation to constitute an upper surface for supporting toilet objects, a pair of depending support plates extending downwardly from the lower surface of the tray with upwardly directed recesses positionable on a towel rack, and vertically extending supports depending downwardly from the rear edge of the tray with an adhesive on their exposed rearwardly facing surfaces for coupling to a wall between the ends of the towel rack.

In U.S. Pat. No. 3,941,325, dated Mar. 2, 1976, Krause disclosed a shelf having front and rear ends which is adapted to rest on a horizontal bar spaced from a wall to which it is attached. A vertical stabilizing member extends downwardly from the rear end portion of the shelf between the bar and the wall and has an adjusting pin projecting from its back into engagement with the wall to hold the shelf horizontal while the back of the shelf engages the wall. The pin also projects from the front of t he stabilizing member and supports a nut that is adjusted forward on the pin to engage the back of the bar to hold the rear ends of the shelf and pin against the wall.

In U.S. Pat. No. Des. 379,570, dated Jun. 3, 1997, Moon disclosed the ornamental design for a shelf, as shown and described.

While these towel adapters may be suitable for the purposes for which they were designed, they would not be as suitable for the purposes of the present invention, as hereinafter described.

SUMMARY OF THE INVENTION

The present invention discloses a shelf adapter for attachment to a conventional towel rack for use in a bathroom, shower stall, or the like. The present invention comprises a pair of parallel generally horizontal members having a female and male telescoping attachment means mounted onto a pair of leg-like mounts which are fastened around the towel rack so as to be removably, fixedly attached to the towel rack. The purpose of the telescoping members is to allow the shelf to be removably, fixedly attached to towels racks of various sizes wherein the telescoping members can be adjusted to fit towel racks of varying lengths. Furthermore, the parallel members have indentions or cutouts disposed therein which form semi-circular cutouts for receiving bottles or bottle necks of various bottled bath condiments which the user might use. The bottles are mounted upside down into the semi-circular cutouts in order to always have the liquid contained in the bottle disposed near the outlet end of the bottle.

An object of the present invention is to convert an otherwise unusable towel bar into a useful storage shelf while it is being used in a wet environment. An additional object of the present invention is to provide an adaptive shelf which can be adjusted to fit many and various types of towel racks. Further, an object of the present invention is to provide an adaptive shelf that can accommodate inverted bottles so that the entire contents of the inverted contents of the inverted bottles can be used.

The foregoing and other objects and advantages will appear from the description to follow In the description reference is made to the accompanying drawings, which form a part hereof, and in which is shown by way of illustration specific embodiments in which the invention may be practiced These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
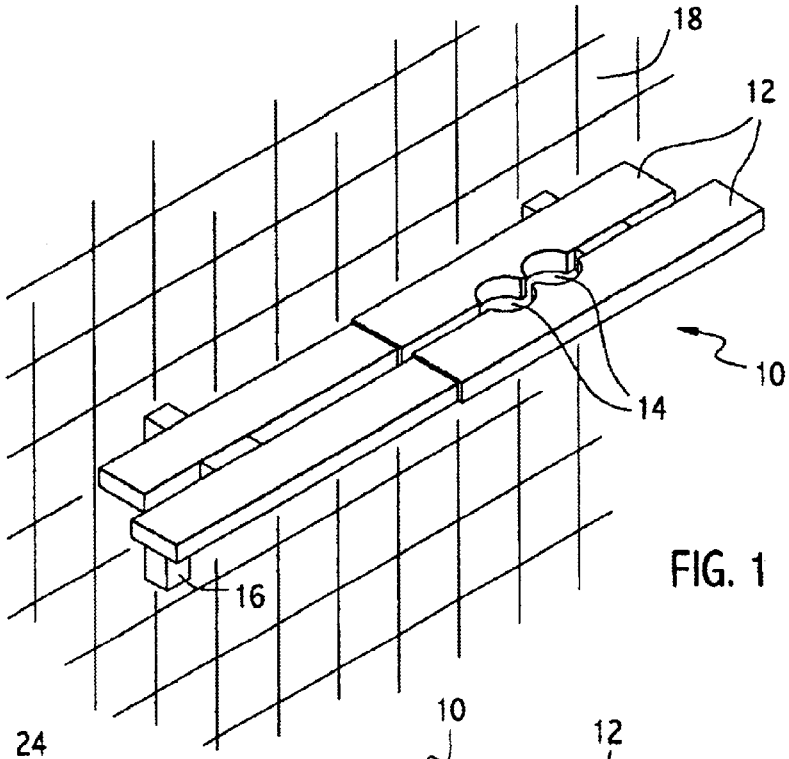
FIG. 1 is a perspective view of the present invention.

With regard to reference numerals used, the following numbering is used throughout the drawings.

| | |
|---|---|
| 10 | present invention |
| 12 | shelf members |
| 14 | bottle neck cutouts |
| 16 | towel rack brace |
| 18 | back wall |
| 20 | existing towel bar |
| 22 | female |
| 24 | male |
| 26 | shelf mounting brace |
| 28 | upper mounting brace |
| 30 | lower mounting brace |
| 32 | fastener means |

DESCRIPTION OF THE PREFERRED EMBODIMENT(S)

In order that the invention may be more fully understood, it will now be described, by way of example, with reference to the accompanying drawings in which FIGS. 1 through 5 illustrate the present invention wherein a shelf adapter for a towel rack is disclosed.

Turning to FIG. 1, therein is shown a perspective view of the present invention 10. Shown are a pair of parallel, generally horizontally disposed shelf-like members 12 each having oppositely positioned semi-circular cutout or indentions 14 disposed therein for receiving the inverted necks of bottles Also shown is the back leg or brace 16 of the towel rack along with the back wall 18 to which the towel rack is mounted.

Figure 2:
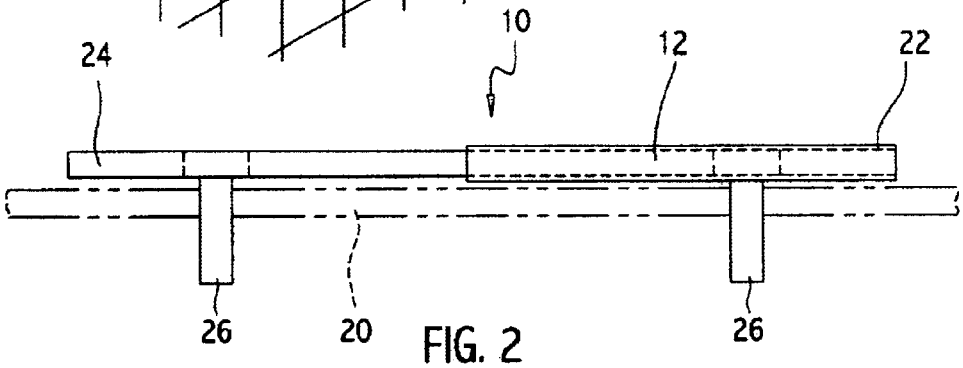
FIG. 2 is a front elevation view of the present invention.

Turning to FIG. 2, therein is shown a front elevation view of the present invention 10 mounted on an existing towel bar 20 showing the pair of parallel members 12 each having a female end 22 and a male end 24 shown being placed so as to have the pair of mounting members 26 positioned to be attached to the existing towel bar 20.

Figure 3:
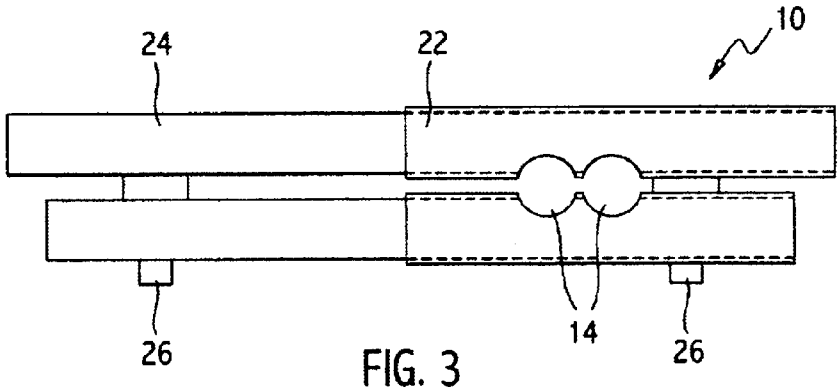
FIG. 3 is a plan view of the present invention.

Turning to FIG. 3, therein is shown a plan view of the present invention 10 showing the female members 22 and the male members 24 of the shelf 12 of the present invention 10. Also shown are the semi-circular bottleneck cutouts 14 along with the mounting braces or legs 26.

Figure 4:
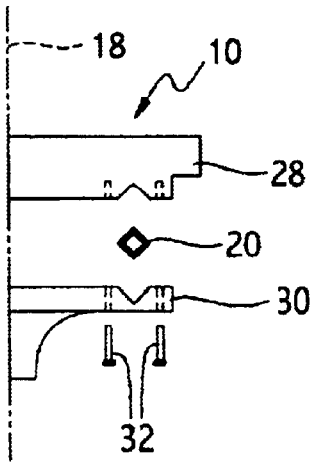
FIG. 4 is a side elevation view of the present invention.

Turning to FIG. 4, therein is shown a side elevation view of the legs or braces 28, 30 of the present invention 10 being connected to an existing towel bar 20 which is attached to a back wall 18. The mounting braces are comprised of an upper member 28 and a lower member 30 removably, fixedly attached to each other by fastener means 32, e.g., threaded screws, whereby the mounting braces 28, 30 can be removed from the towel bar and adjusted so as to allow the shelf to be adapted to various widths of towel bars.

Figure 5:
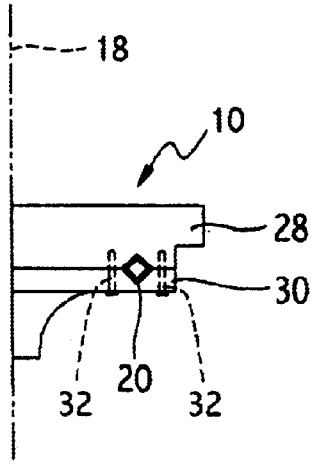
FIG. 5 is a side elevation view of the present invention.

Turning to FIG. 5, therein is shown a side elevation view of the present invention 10 showing the lower mounting brace 30 and upper mounting brace 28 fixedly attached to a towel bar 20.

Figure 6:
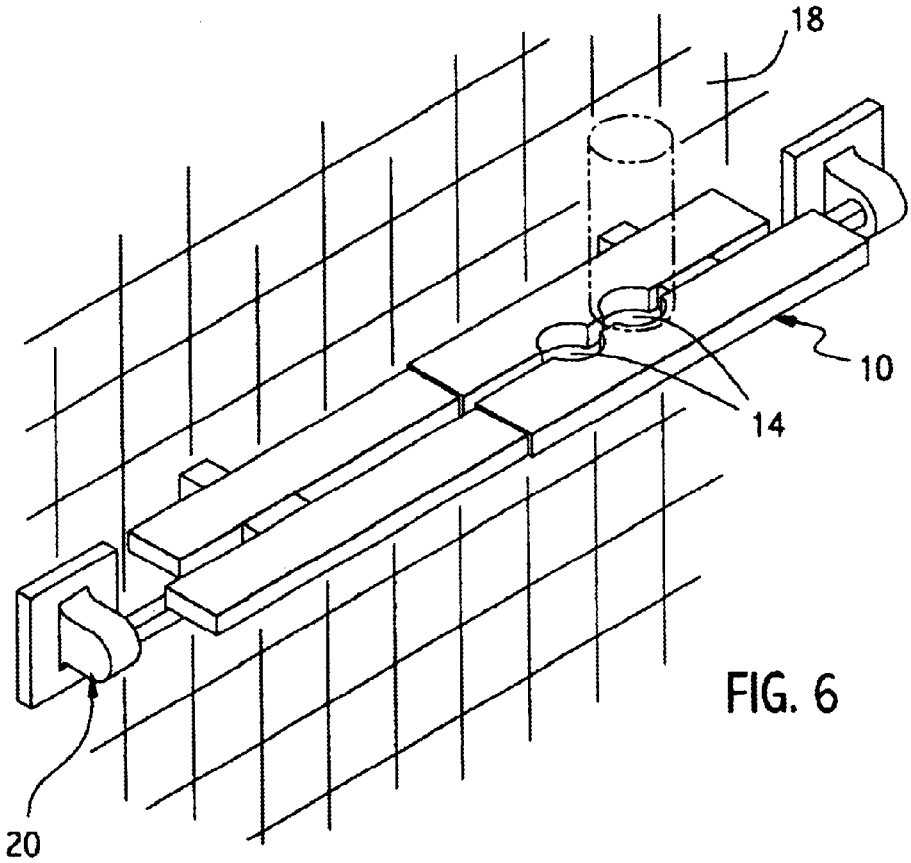
FIG. 6 is a photograph of the present invention mounted onto a conventional towel bar.

Turning to FIG. 6, therein is shown the present invention 10 mounted onto a conventional towel bar 20 which is mounted onto the wall 18.

What is claimed to be new and desired to be protected by letters patent is set forth in the appended claims.

I claim:

1. An apparatus for a shelf adaptable for attachment to a conventional towel bar, comprising:

a) at least a pair of elongated shelf members, said shelf members being substantially horizontal, said shelf members being disposed on a conventional towel bar;

b) wherein said shelf members further comprise a female portion for receiving a male portion therein;

c) wherein said shelf members further comprise a male portion for insertion into said female portion to permit the length of said shelf members to be varied;

d) means for attaching said shelf members to a conventional towel bar whereby the length of the shelf members is adjusted before the shelf members are fixed on the towel bar to permit use with towel bars of various lengths; and, e) wherein said shelf members have a plurality of cutouts therein, cutouts in one shelf member facing cutouts in another shelf member to form an opening to receive a bottleneck to be inserted therein.

2. The apparatus of claim 1, wherein said means for attaching said shelf members to a convention towel bar comprises at least a pair of downwardly extending mounting braces to permit attachment to a conventional towel bar.

3. The apparatus of claim 2, wherein said downwardly extending mounting braces comprise an upper portion and a lower portion for receiving a conventional towel bar thereinbetween.

4. The apparatus of claim 3, wherein said upper portion and said lower portion of said mounting brace each have an opposed recess therein, said recess for receiving a conventional towel bar therein.

5. The apparatus of claim 4, further comprising fasteners for joining said lower portion to said upper portion of said mounting brace.

* * * * *